US006726037B2

(12) United States Patent
Chandaria

(10) Patent No.: US 6,726,037 B2
(45) Date of Patent: Apr. 27, 2004

(54) DISPLAY CARD FOR MERCHANDISING STRIPS AND METHOD OF MANUFACTURING SAME

(75) Inventor: Ashok Velji Chandaria, Nairobi (KE)

(73) Assignee: Conros Corporation, Ontario (CA)

( * ) Notice: Subject to any disclaimer, the term of this patent is extended or adjusted under 35 U.S.C. 154(b) by 0 days.

(21) Appl. No.: 10/232,271

(22) Filed: Aug. 29, 2002

(65) Prior Publication Data

US 2004/0040921 A1 Mar. 4, 2004

(51) Int. Cl.[7] ..... A47F 7/00; A47F 5/08

(52) U.S. Cl. ..... 211/113; 40/657; 40/124.4; 206/461; 206/486

(58) Field of Search ..... 211/113; 206/466, 206/488, 477, 461, 486; 40/124.4, 657, 673, 618, 617

(56) References Cited

U.S. PATENT DOCUMENTS

| | | | | | |
|---|---|---|---|---|---|
| 1,785,498 | A | * | 12/1930 | Savageau | 206/466 |
| 2,272,623 | A | * | 2/1942 | Runner | 206/466 |
| 3,029,939 | A | * | 4/1962 | Feldman | 206/466 |
| 4,312,449 | A | * | 1/1982 | Kinderman | 206/466 |

FOREIGN PATENT DOCUMENTS

| | | | | |
|---|---|---|---|---|
| FR | 0159267 A1 | * | 10/1985 | A47F/7/00 |

* cited by examiner

*Primary Examiner*—Daniel P. Stodola
*Assistant Examiner*—Erica B. Harris
(74) *Attorney, Agent, or Firm*—Sand & Sebolt

(57) ABSTRACT

A merchandising display card for displaying products is a sheet that includes a number of slits that are adapted to receive tabs from the packaging of the products to be displayed. Each slit has a boss projecting into it. The boss is adapted to engage in a slot in the packaging tab. When the sheet is hung for display, the product is maintained thereon by gravity.

8 Claims, 4 Drawing Sheets

DISPLAY CARD FOR MERCHANDISING STRIPS AND METHOD OF MANUFACTURING SAME

TECHNICAL FIELD

This invention generally relates to a display card for merchandise and to a method for manufacturing the same. More particularly, the invention relates to a display card for merchandise that is adapted to display products that have a tab extending from their packaging. Specifically, the invention relates to a slotted display card that has a mechanism for engaging the tabs of product packaging.

BACKGROUND INFORMATION

Retailers have frequently used clip strips or clip sheets for displaying products that are too small to place on shelves or that are seasonal in nature. The strips or sheets are hung on other product displays or on shelf supports so that they do not take up valuable shelf space.

The clip strips and sheets used in the prior art are typically manufactured from a lightweight plastic that has been die-cut to produce a plurality of upwardly extending pegs that are each flanked by two downwardly extending legs. The products for display need to be mounted onto a cardboard backing sheet that includes a hole toward its upper end. The peg of the clip strip is inserted through the hole and the legs engage over a portion of the uppermost end of the cardboard backing sheet. In this manner the product is attached to the clip strip or sheet. The attachment of the products onto the clip strip or sheet is a labor intensive operation inasmuch as every single product has to manually be mounted onto a peg on a clip strip. Once the products are mounted onto the clip strips or sheets, they are packaged and sent to the retailer. During transit, the products tend to become disengaged from the pegs. It is not uncommon for retailers to find that around 50% of the products have become detached from the clip sheets or strips. It is then up to the retailer to reinstall the products onto the strips. The clip strips or sheets are then hung onto the displays or shelf supports so that consumers can see them.

Apart from the disengagement of the products from previously known clip sheets and strips during shipping, these products have also had other disadvantages for the retailer. The first of these is that a fairly limited number of products may be displayed on any one clip strip or sheet. Secondly, when consumers remove the products from the clip strips, they may accidentally disengage other products from the strip. Once a peg has been used, it tends to become slightly deformed and consequently if a consumer attempts to reattach products onto the clip strip, they tend to fall off again. After a few attempts the consumer is likely to give up and place the product on another shelf. This leaves the retailer with the problem of not having products adequately on display in the store and having to repeatedly reattach products onto the strips or sheets. Even if the products remain on the sheets, the displays tend to be messy in appearance. This does not enhance the aesthetic appeal of the clip strip display and does not aid in selling the product.

Several devices have been developed to address these problems. These devices have included metal rods with metal clamps mounted on them or thin metal strips with upwardly extending metal hooks. In some instances, like the device with metal clamps, the problem of products disengaging during shipping have been greatly reduced. The devices are, however, far more expensive to manufacture and still require the manual installation of products.

There is therefore still a need in the art for an inexpensive, easily manufactured and shipped, display card for displaying various products.

The device of the present invention is a sheet that has a simple yet effective means for securing products to it. The sheet include at least one slit that is adapted to receive the tab from the packaging of a product to be displayed. A boss projects into the slit. The boss is adapted to engage a slotted tab that extends from the packaging of the product. The tab from the product is inserted through the slit in the display card and the slot in the tab is brought into engagement with the boss on the sheet. The sheet is adapted to be hung on a store display and consequently the product is suspended from the boss and kept in position by gravity.

The product's packaging tabs are preferably provided with perforations so that when a consumer wishes to purchase the product, they pull on the product, the perforations tear and the product is released from the display card.

BRIEF DESCRIPTION OF THE DRAWINGS

The preferred embodiment of the invention, illustrative of the best mode in which applicant has contemplated applying the principles, are set forth in the following description and are shown in the drawings and are particularly and distinctly pointed out and set forth in the appended claims.

DETAILED DESCRIPTION OF THE INVENTION

Figure 1:
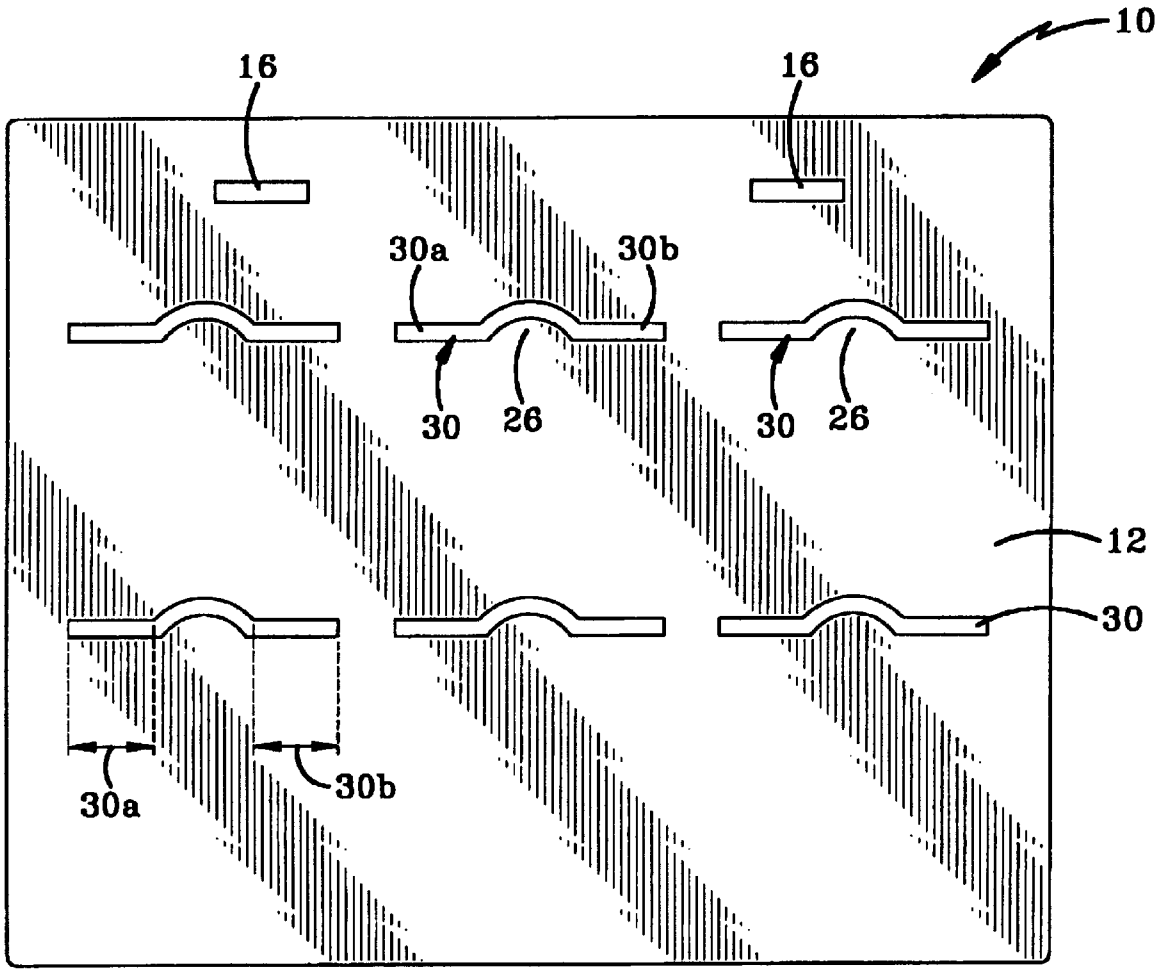
FIG. 1 is front view of the display card of the present invention.

The device of the present invention is shown in FIGS. 1 through 4.

The display card is generally represented by the number 10. Display card 10 comprises a sheet 12 that may be manufactured from any suitable material such as plastic, cardboard or corrugated plastic (coreplast) that is of sufficient strength and rigidity to hold the product 20 to be displayed thereon.

Display card 10 defines a pair of holes 16 through which hooks (not shown) may be received to hang card 10 for display in a retail store. Any other suitable number of holes 16 may be provided. Alternatively, any other suitable mechanism may be provided for hanging or holding display card 10 in a store.

Display card 10 further defines at least one slit 30 that is adapted to receive a tab 32 of the packaging of a product 20 therethrough. Card 10, preferably, has a plurality of rows of slits 30 therein as is shown in FIG. 1. Display card 10 further defines a boss 26 that projects from the main body of sheet 12 into slit 30. Slit 30 has a length and boss 26 is preferably adapted to project into slit 30 approximately in the middle thereof. In the attached figures, boss 26 is semi-circular in shape. Boss 26 may, however, be triangular, rectangular or any other shape that is suitable for capturing the packaging of product 20. Boss 26 is preferably located substantially in the central region of slit 30 so that substantially equal lengths 30*a*, 30*b* of slit 30 extend axially from boss 26. Boss 26 may however be positioned at any point along the length and breadth of the slit 30.

Figure 2:
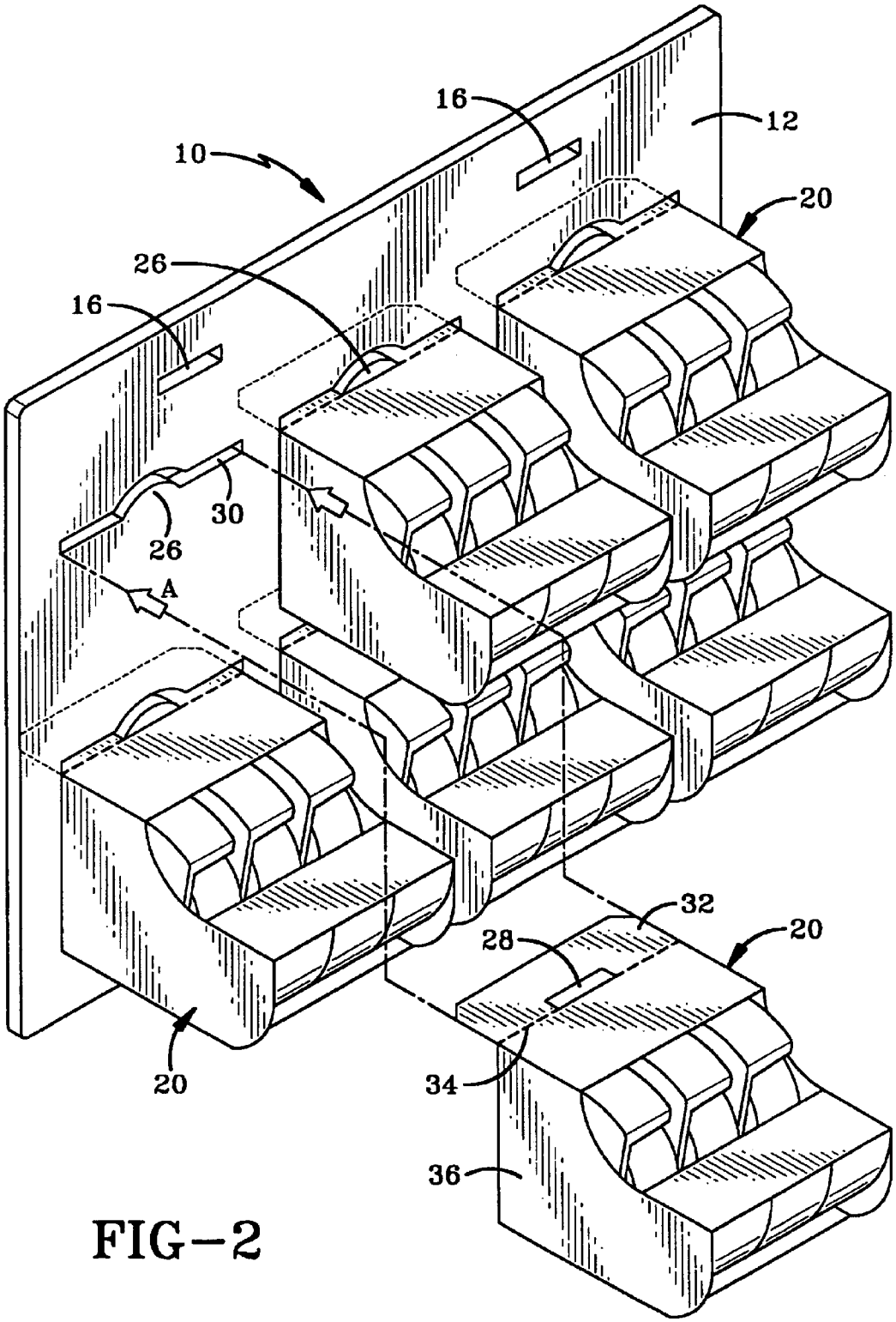
FIG. 2 is a front perspective view of the display card of FIG. 1 showing how a product is brought into engagement with the card.

As may be seen from FIG. 2, the packaging of product 20 includes a tab 32 that extends from the packaging. Tab 32 defines a slot 28 and preferably includes perforations 34. Boss 26 is adapted to engage slot 28, thereby allowing product 20 to be mounted on display card 10. When display card 10 is hung by hooks (not shown), products 20 are suspended on display card 10 and are kept in position by gravity.

During manufacture, tabs 32 on products 20 are suitably aligned to be inserted into slits 30. Products 20 are brought into close proximity to sheet 12 and are engaged with slits 30 one at a time or several products may be grasped by suitable machinery (not shown) and moved toward display card 12 in the direction of arrow A (FIG.2). Tabs 32 are inserted into slits 30 in such a manner that tabs 32 do not engage bosses 26. Product 20 is then moved relative to display card 10 so that bosses 26 enter slots 28. The fit between each boss 26 and slot 28 is preferably sufficiently tight to prevent accidental withdrawal of tab 32 from slot 28. The shape of boss 26 preferably allows for easy entry of boss 26 into slot 28. The size of boss 26 is configured to closely approximate that of slot 28 in tab 32 to preferably prevent product 20 from being removed from display card 10 unless perforations 34 on tab 32 are torn.

Once boss 26 is inserted into slot 28, product 20 is engaged with card 10 and display card 10 is ready for display. During manufacture, a plurality of products 20 are brought into simultaneous engagement with display card 10.

Figure 3:
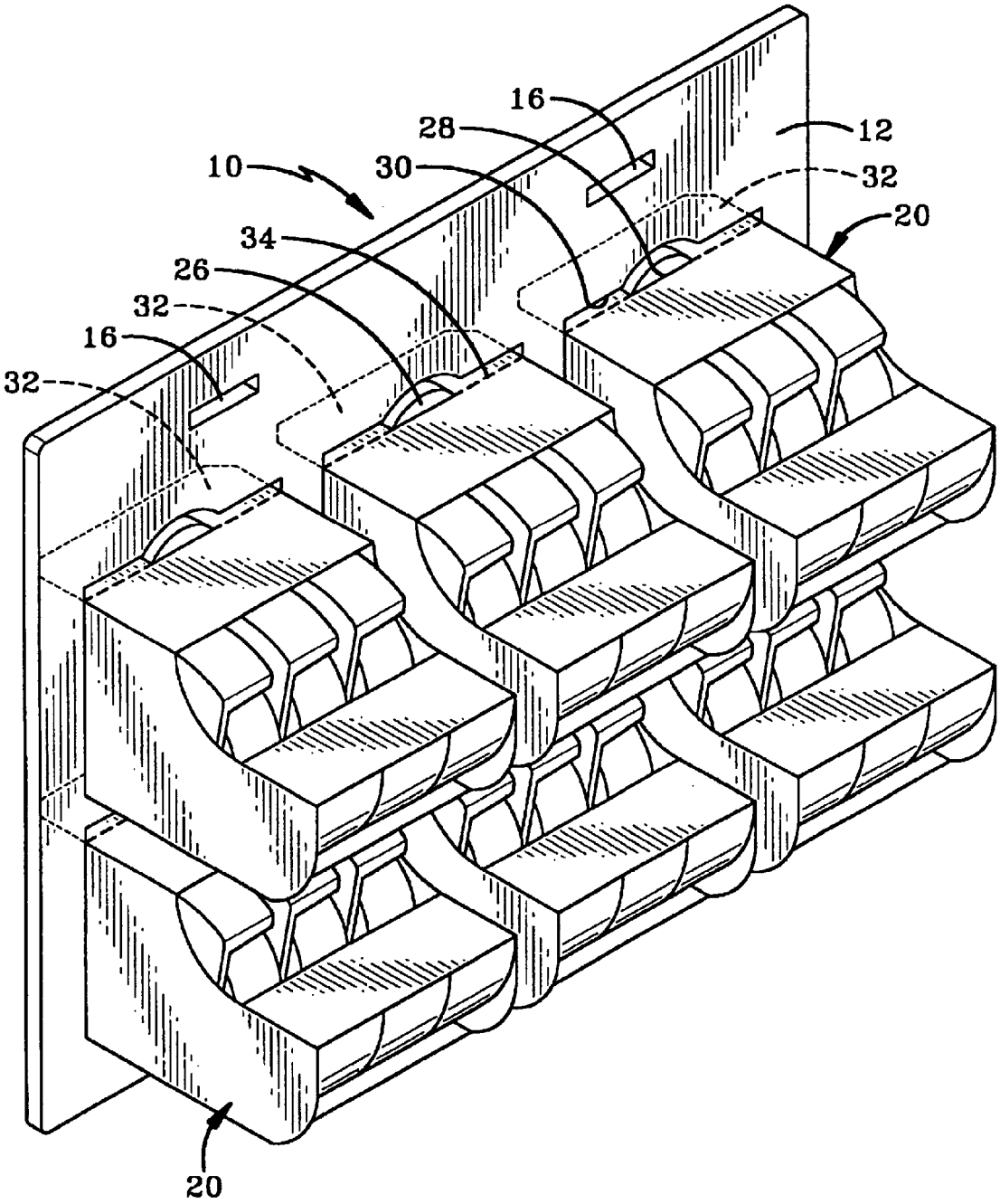
FIG. 3 is a front perspective view of the display card of FIG. 1 showing how the products are held in position by gravity.

Tabs 32 from products 20 are simultaneously inserted into slits 30 and bosses 26 are brought into engagement with slots 28. Tabs 32 may be allowed to continue to extend at 90 degrees relative to display card 10. Alternatively, product packaging 36 (as shown in FIG. 3) may be pressed into engagement with rear side (not shown) of card 10.

Once all products 20 are installed onto display card 10, card 10 may be boxed for shipping. Because bosses 26 engage firmly in with slots 28, products 20 do not easily become dislodged during shipping. When the retailer removes display card 10 from the shipping boxes (not shown), products 20 remain intact with display card 10. The card 10 may then be hung by inserting hooks (not shown) into holes 16. At this point, products 20 remain engaged on card through the action of gravity. Gravity pulls downwardly on the product 20 keeping boss 26 firmly engaged in slot 28.

Figure 4:
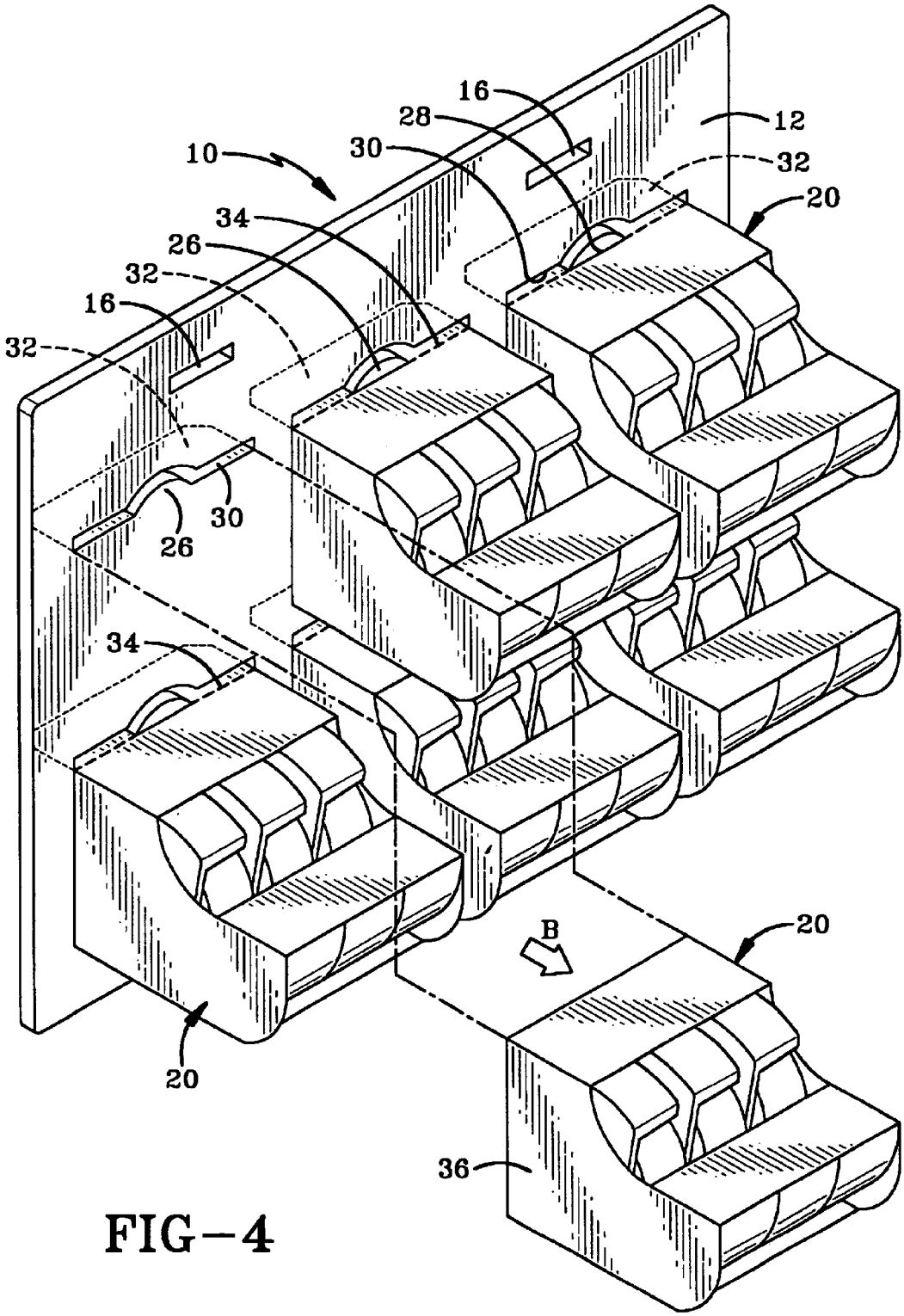
FIG. 4 is a front perspective view of the display card of FIG. 1 showing how products are withdrawn from the card.

When a consumer wishes to remove a product 20 from display card 10, they firmly grasp the packaging 36 and pull in the direction of arrow B (FIG. 4). Perforations 34 tear, allowing product 20 to be removed from display card 10.

The method of manufacturing display card 10 for merchandising product 20 that has a tab 32 extending from its packaging, comprises the steps of:

a) forming at least one hole 16 in a sheet 12;

b) forming at least one slit 30 in a sheet 12, leaving a boss 26 projecting into slit 30;

c) bringing a product 20 sufficiently close to sheet 12 so as to allow a tab 32 extending from the product packaging to be inserted into slit 30 without engaging boss 26;

d) moving one of sheet 12 or product 20 relative to the other so as to allow boss 26 to engage in a slot 28 in tab 32.

The method of manufacturing display card 10 may further include the step of:

a) bending tab 32 into engagement with the rear side of sheet 12.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. A method of manufacturing and using a display card for merchandising a product that has a tab extending from its packaging, the tab defining a slot therein; the method comprising the steps of:

a) forming at least one hole in a sheet;

b) forming at least one slit in the sheet while leaving a boss projecting into slit; the slit having a top edge and a bottom edge and the boss extending from the bottom edge of the slit toward the top edge of the slit;

c) bringing the product sufficiently close to the sheet so as to allow the tabs which extends from the product in a first position, to be inserted into the slit without engaging the boss;

d) inserting the tab into the slit;

e) moving one of the sheet and the product relative to the other so as to allow the boss to engage in the slot of the tab.

2. The method of manufacturing and using a display card as defined in claim 1, further comprising the step of:

a) bending the tab into a second position relative to the first position, wherein the tab engages with the rear side of the sheet.

3. The method of manufacturing and using a display card as defined in claim 2, further comprising the step of:

a) hanging the sheet with the attached product onto a merchandising display.

4. In combination, a merchandising display card and a packaged product for display thereon, the combination comprising:

a) a merchandising display card, the display card comprising a sheet having a front side and a rear side and, defining at least one slit therein, the slit having a top edge and a bottom edge, the sheet having a boss that projects partially into the slit from the bottom edge thereof toward the top edge;

b) a packaged product for display on the display card, the product having a tab extending from its packaging, the tab defining a slot therein and the slot being sized to receive the boss therethrough; the tab being movable from a first position where it extends outwardly from the packaging to a second position where it is bent relative to the first position;

wherein the tab extends through the slit of the display card and the boss engages the slot in the tab, and, after the boss is inserted into the slot, the tab is moved from the first position into the second position to engage the rear side of the sheet to secure the product to said sheet.

5. The combination of claim 4, wherein the boss is semi-circular.

6. The combination of claim 4, wherein the sheet defines a plurality of rows of slits, each slit having a boss projecting thereinto from the sheet and the combination further includes a plurality of packaged products.

7. The combination of claim 4, wherein the sheet further defines at least one hole for hanging the display card vertically.

8. The combination of claim 4, wherein the tabs further include a plurality of perforations that are disposed proximate the front side of the sheet when the boss is engaged with the slot.

* * * * *